US012571283B2

(12) United States Patent
Hale et al.

(10) Patent No.: US 12,571,283 B2
(45) Date of Patent: Mar. 10, 2026

(54) USE OF MINERAL INSULATED HEATERS TO APPLY EUTECTIC METALS TO REMEDIATE LOST CIRCULATION

(71) Applicants: ARAMCO SERVICES COMPANY, Houston, TX (US); NEWPARK DRILLING FLUIDS, LLC, Katy, TX (US)

(72) Inventors: Arthur Hale, Angleton, TX (US); Ahmed Said Abdelaziz Amer, Katy, TX (US)

(73) Assignees: SAUDI ARABIAN OIL COMPANY, Dhahran (SA); NEWPARK DRILLING FLUIDS, LLC, Katy, TX (US)

( * ) Notice: Subject to any disclaimer, the term of this patent is extended or adjusted under 35 U.S.C. 154(b) by 0 days.

(21) Appl. No.: 18/621,788

(22) Filed: Mar. 29, 2024

(65) Prior Publication Data

US 2025/0305384 A1 Oct. 2, 2025

(51) Int. Cl.

| | |
|---|---|
| ***E21B 33/138*** | (2006.01) |
| ***E21B 33/134*** | (2006.01) |
| ***E21B 36/04*** | (2006.01) |

(52) U.S. Cl.

CPC ..... *E21B 33/138* (2013.01); *E21B 33/134* (2013.01); *E21B 36/04* (2013.01)

(58) Field of Classification Search

None

See application file for complete search history.

(56) References Cited

U.S. PATENT DOCUMENTS 3,208,530 A * 9/1965 Allen ..... E21B 36/00 166/123
3,852,200 A * 12/1974 Meyer ..... C09K 8/206 507/143

(Continued)

FOREIGN PATENT DOCUMENTS

WO 2018191158 A1 10/2018
WO 2021221513 A1 11/2021

OTHER PUBLICATIONS

International Search Report and Written Opinion issued in Application No. PCT/US2025/020626, mailed on May 12, 2025 (14 pages).

*Primary Examiner* — Andrew Sue-Ako

(74) *Attorney, Agent, or Firm* — Osha Bergman Watanabe & Burton LLP

(57) ABSTRACT

A method for sealing a section of a well with a downhole plugging assembly using a basket containing a mineral insulated heater by running the downhole plugging assembly through the well and activating the mineral insulated heater. The heater melts the eutectic metal alloy to fill the downhole location with the melted alloy. The mineral insulated heater is deactivated and the melted eutectic alloy cools to form a plug. A method for sealing a section of a well using a downhole plugging assembly containing a carrier fluid and a mineral insulated heater. The method includes running the downhole plugging assembly into the well, flowing the eutectic alloy suspended in the carrier fluid, connecting the electrical connection to a power source, and activating the mineral insulated heater to melt the eutectic alloy to fill the downhole location. The method includes allowing the eutectic alloy to cool to form a eutectic plug.

9 Claims, 4 Drawing Sheets

(56) References Cited

U.S. PATENT DOCUMENTS

| | | | | |
|---|---|---|---|---|
| 6,474,414 | B1 | 11/2002 | Gonzalez et al. | |
| 6,523,610 | B1 * | 2/2003 | Griffith | E21B 43/10 166/57 |
| 7,934,552 | B2 | 5/2011 | La Rovere | |
| 11,401,776 | B2 | 8/2022 | Carragher et al. | |
| 12,037,870 | B1 * | 7/2024 | Hale | E21B 33/138 |
| 2009/0258800 | A1 * | 10/2009 | Halliday | C09K 8/032 507/140 |
| 2015/0233211 | A1 * | 8/2015 | Bujold | E21B 36/00 166/60 |
| 2018/0094504 | A1 * | 4/2018 | Hearn | A01H 5/10 |
| 2020/0149379 | A1 | 5/2020 | Malone et al. | |
| 2020/0332620 | A1 | 10/2020 | Carragher | |
| 2022/0243553 | A1 | 8/2022 | Shafer | |
| 2022/0251929 | A1 | 8/2022 | Gibb | |
| 2023/0287756 | A1 | 9/2023 | Carragher et al. | |

* cited by examiner

USE OF MINERAL INSULATED HEATERS TO APPLY EUTECTIC METALS TO REMEDIATE LOST CIRCULATION

BACKGROUND

Lost circulation is a major issue associated with drilling wells, resulting in significant costs in repair and product loss. Lost circulation occurs when drilling fluid flows into one or more geological formations instead of returning up the annulus as the final product while drilling for oil. When this occurs, a lost circulation pill is typically utilized. The pill is transported with a carrier fluid to the zone to seal the fracture and stop the loss of drilling fluid.

Currently, eutectic metal alloys are used for fracture repairs, as they melt at relatively low temperatures and solidify when cooled. These existing methods do not place the eutectic metal alloy accurately and close enough to a heat source for adequate melting at targeted locations. The existing methods for depositing eutectic metal alloys for repairs include the use of a carrier fluid, typically polymeric or bentonitic, and through a mechanical delivery system.

A heat source is necessary to melt the eutectic metal so that it can reach the desired location, and then the heating source is removed or deactivated to allow the eutectic metal alloy to cool and solidify to repair the fractures. Thermite heaters are commonly used in this application.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method for sealing a section of a well using a downhole plugging assembly. The downhole plugging assembly includes a basket containing eutectic metal alloy particles and a mineral insulated heater through the center of the basket. The mineral insulated heater includes a metallic alloy inner core, a magnesium oxide insulation surrounded by a stainless steel sheath, and an electrical connection. The downhole plugging assembly is run through a well to a downhole location before activating the mineral insulted heater to melt the eutectic metal alloy particles. The melted eutectic metal alloy particles melt from the basket and fill the downhole location with the melted eutectic alloy. The mineral insulated heater is deactivated after the eutectic metal alloy particles have melted to allow the melted eutectic alloy to cool, forming a eutectic metal plug, plugging the downhole location.

In another aspect, embodiments disclosed herein relate to a method for sealing a section of a well using a downhole plugging assembly consisting of a carrier fluid and a mineral insulated heater. The carrier fluid contains an aqueous, polymeric composition and the eutectic metal alloy in suspension. The mineral insulated heater contains a metallic alloy inner core, a magnesium oxide insulation surrounded by a stainless steel sheath, and an electrical connection at the end of the mineral insulated heater opposite the base. The downhole plugging assembly is run into the well to a downhole location where the eutectic metal alloy suspended in the carrier fluid is flowed to the downhole location. The electrical connection of the mineral insulated heater is connected to a power source via a wireline and the mineral insulated heater is activated to melt the eutectic alloy in the carrier fluid to fill the downhole location with the melted eutectic alloy and the carrier fluid. The melted eutectic alloy cools to form a plug in the downhole location.

Other aspects and advantages of the claimed subject matter will be apparent from the following description and the appended claims.

DETAILED DESCRIPTION

In one aspect, embodiments disclosed herein relate to a mineral insulated heat apparatus for eutectic metal application in lost circulation incidences.

Currently, eutectic metal applications generally use carrier fluids, which can be inaccurate in targeting specified locations. Additionally, thermite heaters are unable to be placed into the hole cycled for multiple treatments of the eutectic metals without being removed and replaced with a new thermite heater.

Figure 1:
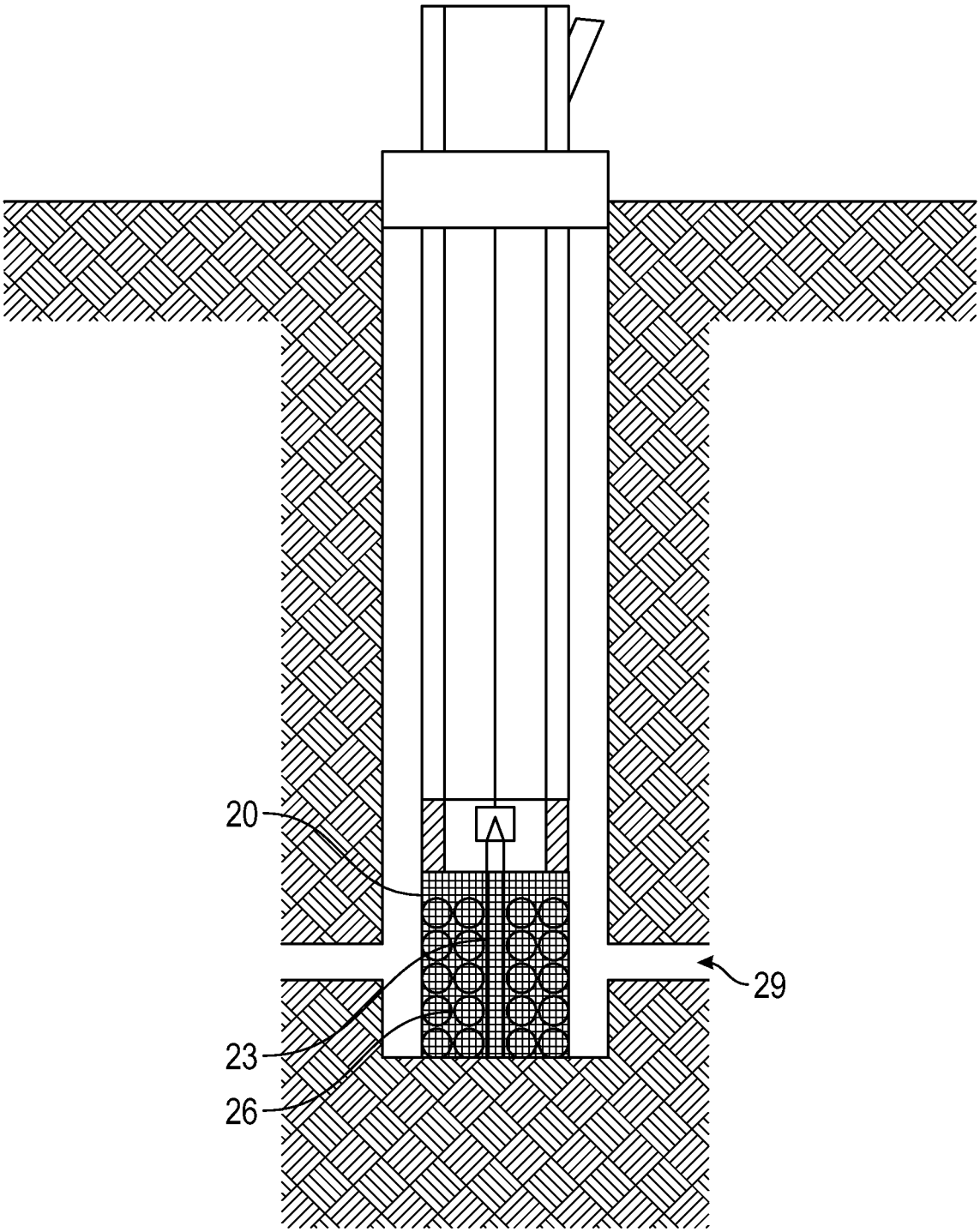
FIG. 1 is a diagram of a downhole plugging assembly apparatus in accordance with one or more embodiments of the present disclosure.

FIG. 1 is a side view of a basket 20 containing a mineral insulated heater 23 while loaded with a plurality of eutectic metal alloy pellets 26. The basket is down the well at the targeted location, adjacent to the fracture 29 requiring repair. The mineral insulated heater 23 has not activated yet, thus the eutectic metal alloy pellets 26 are in solid form.

Figure 2:
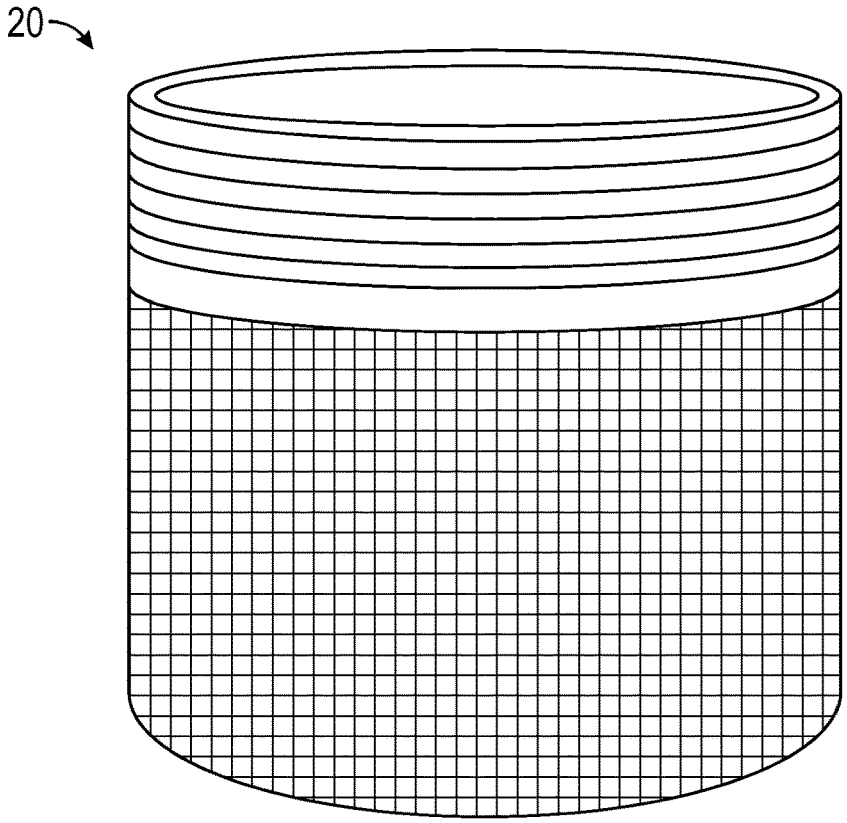
FIG. 2 is a diagram of a basket that will contain eutectic metal alloy pellets in accordance with one or more embodiments of the present disclosure.

In one aspect, embodiments disclosed herein relate to a method of sealing a section of a well with a eutectic metal alloy using a downhole plugging assembly. As shown in FIG. 2, the method may include the use a basket 20 to carry the eutectic metal alloy to the location requiring sealing. FIG. 2 is a front, 3-dimensional view of the basket 20. The basket 20 contains holes with diameter less than that a eutectic metal alloy pellet, allowing the pellets to retain within the basket 20 in cool conditions and to flow out of the basket 20 once melted. The eutectic metal alloy pellets have an average diameter ranging from 0.00005 meters to 0.004 meters. The basket 20 may be physically attached to the downhole tool by a threaded pipe connecting into a threaded connection in the basket, coiled tubing heater, or other method. The method includes running the basket down the well to a downhole location. In order to survive downhole conditions and the melting process, the basket 20 may be made of a material with a significantly higher melting temperature than that of the eutectic metal alloy. For example, the basket may be made of temperature resistant materials that can be machined.

Figure 3:
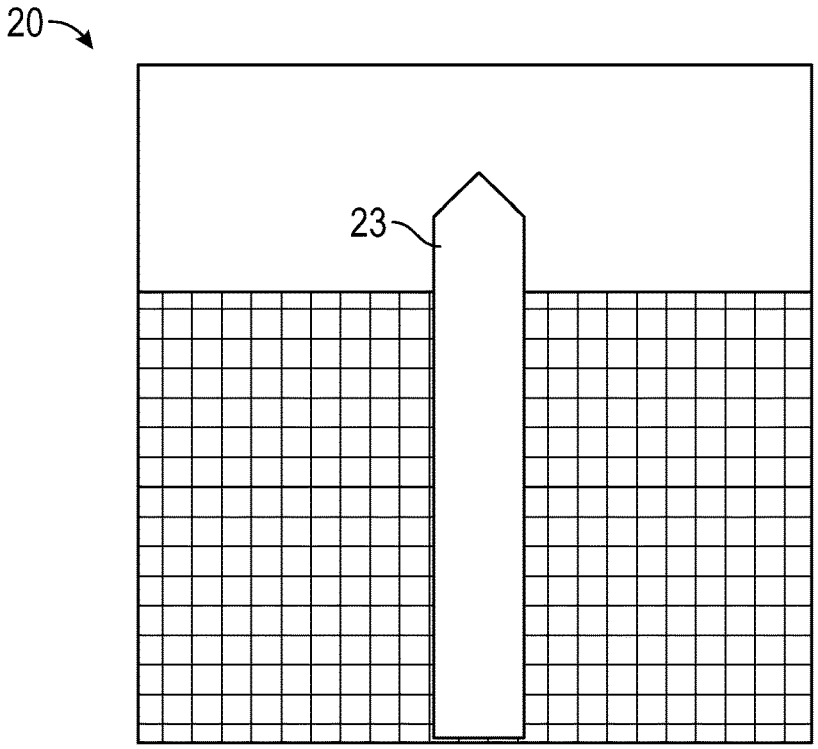
FIG. 3 is a diagram of a basket that will contain eutectic metal alloy pellets, showing a mineral insulated heater in the center of the basket, in accordance with one or more embodiments of the present disclosure.

The method includes the use of a mineral insulated heater 23 extending into the basket 20, as shown in FIG. 3. FIG. 3 illustrates a similar view as FIG. 2, but in 2-dimensional form, with the mineral insulated heater 23 visible through the center of the basket. The location of the mineral insulated heater ensures adequate and direct heating of the eutectic metal alloy pellets. Precise heating allows for accurate placement of the eutectic metal alloy. The mineral insulated heater 23 contains an inner core that can be constructed of various alloys depending on heating specifications. For example, the inner core may have a diameter of 0.5 mm to 0.5 cm, and may be made of materials such as those in the Table below, including Constantan, Alloy 180, Alloy 90, and Alloy 30.

| | Elect. Resistivity | | | | | | | |
|---|---|---|---|---|---|---|---|---|
| | Ω mm2/m | Circular mil Ω/ft | Ni | Cr | Cu | Mg | Fe | Si |
| Constantan | 0.49000 | 295 | 45% | | 55% | | | |
| Alloy 180 | 0.30000 | 180 | 22% | | 78% | | | |
| Alloy 90 | 0.15000 | 90 | 10% | | 90% | | | |
| Alloy 30 | 0.04880 | 30 | 2% | | 98% | | | |

The inner core is commonly insulated with magnesium oxide and is surrounded by a stainless steel sheath. The mineral insulated heater 23 requires an electrical connection for operation. The mineral insulated heater 23 can be directed to the targeted location in several ways. In some embodiments, the mineral insulated heater 23 may be lowered by coil tubing with a copper inner core to provide power to the mineral insulated heater 23. In other embodiments, the mineral insulated heater 23 may be adhered to a pipe that is lowered to the targeted location. In yet other embodiments, the mineral insulated heater 23 is an integral part of the basket, which will be lowered to the targeted location.

Figure 4:
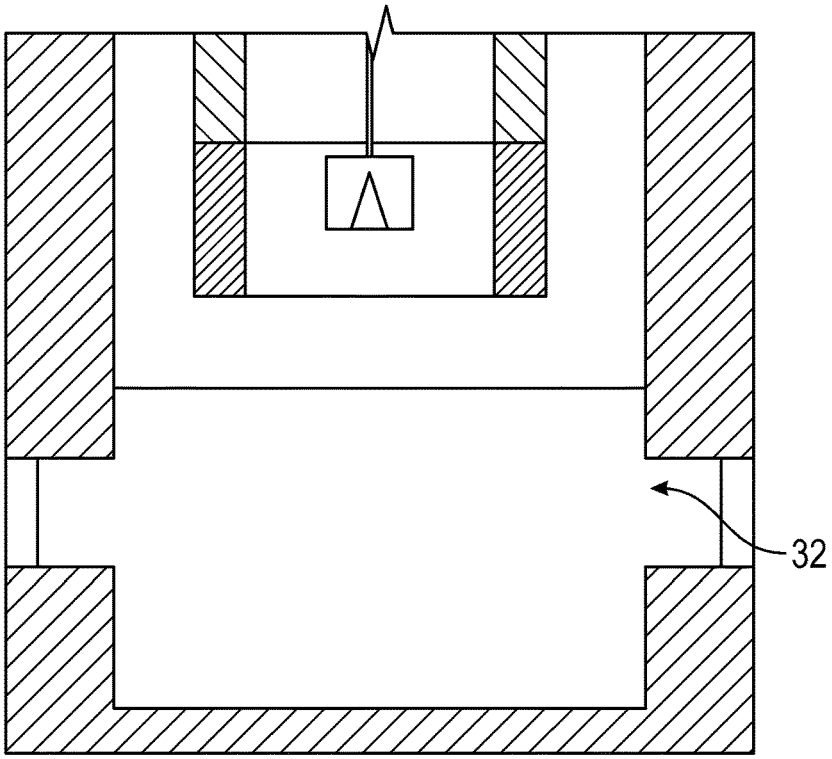
FIG. 4 is a diagram of the basket filled with eutectic metal alloy lowered to the location of fracture in accordance with one or more embodiments of the present disclosure.

FIG. 4 illustrates the next stage in this process from the same side view, as the mineral insulated heater 23 is activated and melts the eutectic metal alloy to form a eutectic metal plug 32 to fill the fractures. The method includes activating the mineral insulated heater 23 once the location of the fracture has been reached by the downhole plugging assembly. Activating the mineral insulated heater 23 will cause the eutectic metal pellets to melt and flow through the basket forming a plug 32. After the eutectic metal pellets have melted and flown in the fracture, the mineral insulated heater 23 is deactivated, allowing the eutectic metal alloy to cool and solidify in the targeted location.

In other embodiments, the use of a carrier fluid with the eutectic metal alloy suspended directly into the fluid may be used instead of the pellets. The carrier fluid is an aqueous, polymeric solution that may be composed of xanthan gum, hydroxy-ethyl cellulose, cross-linked guar gum, polysaccharides, or polyacrylates cross-linked with metallic ions including chromium, titanium, zirconium, and aluminum. The carrier fluid will flow to the targeted zone with pumps or in a gravity settling process. The heating process disrupts the carrier fluid composition, allowing the alloy specifically to flow into the formation.

Figure 5:
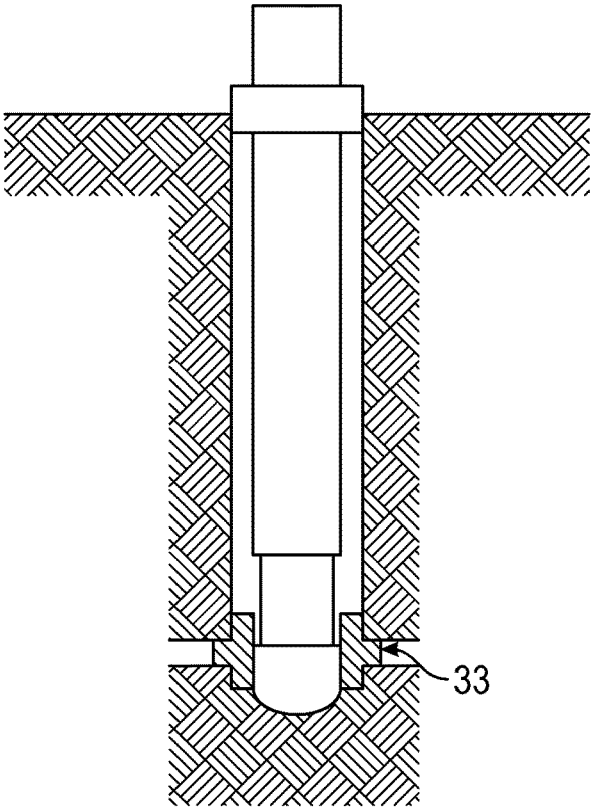
FIG. 5 is a diagram of a eutectic metal alloy melting to fill the void space around a fracture in accordance with one of more embodiments of the present disclosure.
Figure 6:
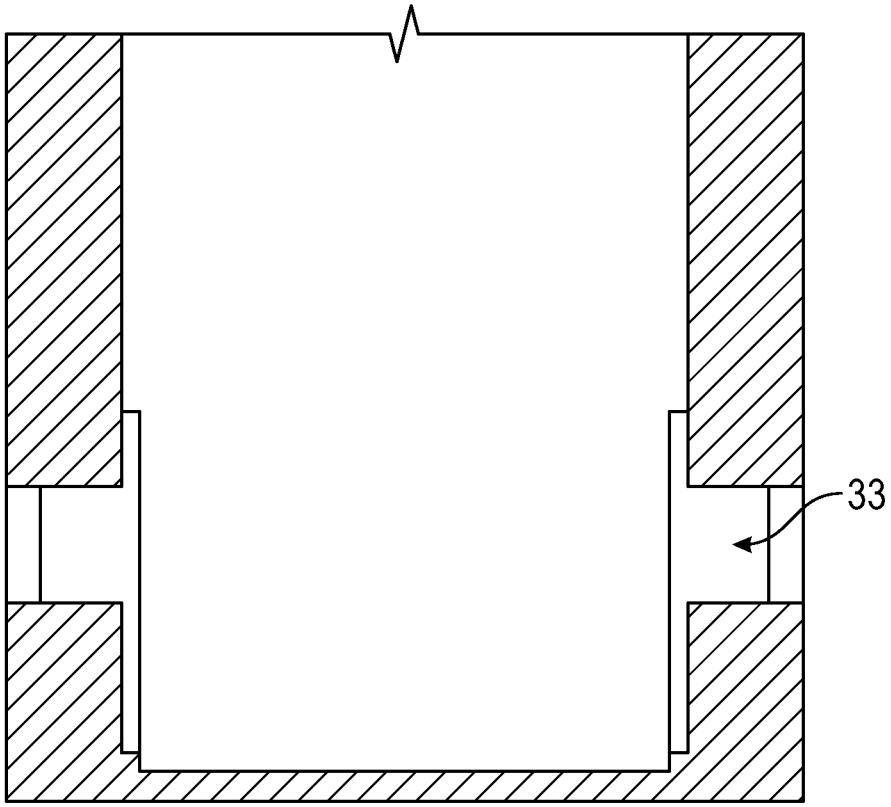
FIG. 6 is a diagram of the eutectic metal alloy solidified only in a targeted location in accordance with one or more embodiments of the present disclosure.

After the eutectic metal is cooled, the mineral insulated heater can be removed by pulling the pipe string and wireless out of the well and a milling assembly can be inserted to mill and surface the well face. FIGS. 5 and 6 illustrate the surface remaining after milling the center of the plug. The milling process then creates a surfaced eutectic metal plug 33, providing a uniform surface.

The method can be repeated by withdrawing the downhole plugging assembly from the targeted zone and reloading with eutectic metal alloy pellets. This allows further repair of the area if the fracture is not sealed upon initial treatment. This may also allow for multiple target zones to be treated.

FIGS. 5 and 6 both demonstrate a similar side view, showing a remaining eutectic metal alloy seal 33 covering the fracture after milling removes the excess plug material. This final portion of the process allows the well to have fractures sealed without blocking the main path of the well unnecessarily.

Embodiments of the present disclosure may provide at least one of the following advantages. Mineral insulated heaters allow for more control of the process. Thermite heaters produce high levels of heat, rapidly before being fully expended. With mineral insulated heaters, there is more control over the heater temperature and time. Additionally, mineral insulted heaters are able to be used repeatedly to melt multiple applications of alloy without removing equipment from the hole. Contrarily, thermite heaters are a single use heater and must be replaced after each use to continue to provide heat.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method for sealing a section of a well, comprising:
providing a downhole plugging assembly, comprising:
a basket, comprising:
a base and a connection end at opposite axial ends of the basket;
a side extending between the base and the connection end; and
a plurality of eutectic metal alloy particles;
a mineral insulated heater extending centrally through the basket from the base, the mineral insulated heater comprising:
a metallic alloy inner core;
a magnesium oxide insulation surrounded by a stainless steel sheath; and
an electrical connection at the end of the mineral insulated heater opposite the base;
running the downhole plugging assembly through the well to a downhole location;
activating the mineral insulated heater and melting a volume of eutectic metal alloy particles to melt from the basket and fill the downhole location with the melted eutectic alloy;
deactivating the mineral insulated heater after the eutectic metal alloy particles have melted; and
allowing the melted eutectic alloy to cool, forming a eutectic metal plug; and
plugging the downhole location.

2. The method of claim 1, wherein the mineral insulated heater is adhered to the downhole plugging assembly in at least one way selected from the group consisting of with a pipe, as an integrated part of the basket, or with coiled tubing containing a copper inner core to provide power to the mineral insulated heater.

3. The method of claim 1, wherein the plugging further comprises:

removing the plugging assembly from the well; and running a milling assembly into the well and milling through the eutectic metal plug, providing a uniform surface.

4. The method of claim 1, wherein the basket further comprises a plurality of holes formed through the base and the side, wherein eutectic metal alloy particles have an average diameter ranging from 0.00005 meters to 0.004 meters and greater than an opening size of the plurality of holes.

5. The method of claim 1, wherein the downhole plugging assembly is withdrawn from a treated zone and reloaded with the eutectic metal alloy particles to repeat the method.

6. A method for sealing a section of a well, comprising:

providing a downhole plugging assembly, comprising:

a carrier fluid, comprising:

an aqueous, polymeric composition; and a eutectic alloy in suspension;

a mineral insulated heater extending centrally through a basket from a base, comprising:

a metallic alloy inner core;

a magnesium oxide insulation surrounded by a stainless steel sheath; and an electrical connection at an end of the mineral insulated heater opposite the base;

running the downhole plugging assembly into the well to a downhole location;

flowing the eutectic alloy suspended in the carrier fluid to the downhole location proximate to the mineral insulated heater, allowing adequate melting at a targeted location;

connecting the electrical connection of the mineral insulated heater to a power source via a wireline;

activating the mineral insulated heater to melt the eutectic alloy in the carrier fluid to flow through the basket and to fill the downhole location with the melted eutectic alloy and the carrier fluid; and plugging the downhole location by allowing the melted eutectic alloy to cool to form a eutectic plug, and wherein the eutectic alloy has an average diameter ranging from 0.00005 meters to 0.004 meters.

7. The method of claim 6, wherein the mineral insulated heater is adhered to the downhole plugging assembly in at least one way selected from the group consisting of with a pipe, as an integrated part of the basket, or with coiled tubing containing a copper inner core to provide power to the mineral insulated heater.

8. The method of claim 6, wherein the plugging further comprises:

removing the mineral insulated heater from the well; and running a milling assembly into the well to mill through the eutectic metal plug, providing a uniform surface.

9. The method of claim 6, wherein the mineral insulated heater can be used multiple times to treat one or more target zones by flowing additional carrier fluid to the one or more target zones.

* * * * *